US005241921A

United States Patent [19]

Sadlak

[11] Patent Number: 5,241,921

[45] Date of Patent: Sep. 7, 1993

[54] WATER SKIING BOOM

[76] Inventor: Michael W. Sadlak, 44 Country La., Vernon, Conn. 06066

[21] Appl. No.: 914,433

[22] Filed: Jul. 15, 1992

[51] Int. Cl.[5] ..... B63B 21/56

[52] U.S. Cl. ..... 114/253; 114/343

[58] Field of Search ..... 52/724, 725, 720, 727, 52/728, 110, 73; 114/250, 253, 254, 364, 343, 90, 242; 434/253; 138/140, 141, 145, 146; 441/68

[56] References Cited

U.S. PATENT DOCUMENTS

| | | | |
|---|---|---|---|
| 3,303,813 | 2/1967 | Collins et al. | 114/235 |
| 3,390,658 | 7/1968 | Jelks . | |
| 3,669,738 | 6/1972 | Cottis et al. | 427/318 |
| 4,237,186 | 12/1980 | Ingraham | 427/435 |
| 4,312,162 | 1/1982 | Medney | 52/727 |
| 4,480,577 | 11/1984 | Naypaver | 114/253 |
| 4,597,346 | 7/1986 | Pollard | 114/90 |
| 5,000,109 | 3/1991 | Anderson | 114/242 |

OTHER PUBLICATIONS

Bart's Catalog, Circa 1991, p. 33.
Barefoot International Catalog, 1992, pp. 1–4.
Spray Marine, Inc. Advertisement, 1992.
Hydronetics, Advertisement, May '91, Water.
Overton's Catalog, 1990, p. 48 Fragment.

*Primary Examiner*—Edwin L. Swinehart
*Attorney, Agent, or Firm*—C. G. Nessler

[57] ABSTRACT

A shaft of water ski boom has a grip portion comprised of a tapered subsection around which is a somewhat compressible polyvinyl chloride sleeve having a thickness tapering in the opposing direction to the shaft, to provide a constant diameter grip. Another shaft subsection has a harder vinyl sleeve where the shaft contacts the boat gunnel. A resilient polyester coating covers the rest of the shaft. The polymer layers are applied by liquid and powder processes using combined curing cycles.

12 Claims, 2 Drawing Sheets

WATER SKIING BOOM

TECHNICAL FIELD

The present invention relates to water ski apparatus, in particular to booms that mount off motorboats and are gripped by water skiers.

BACKGROUND

In water skiing, a person planes across the water on one or two skis, or even on barefeet, while pulled by a boat or other means. One manner of skiing involves the use of water ski booms. Typically they are round bars extending across the gunnel of motor boats, as shown in FIG. 1. Booms are contrasted with the older familiar manner of connecting a water skier with the tow boat by affixing a line and hand-grip harness to the rear of the boat. Booms are convenient for several applications. First, they position the skier in the more quiescent water aside the boat. Second, the skier can be abreast the boat and thus receive instruction from persons in the boat. Third, the boom itself can be gripped, as compared to having a trailing line and harness, to provide the neophyte skier, especially, with more stability. Griping the boom also makes it easier to plane on the water when starting from the still position, because the skier's body is initially more nearly upright.

Booms which have lines and hand-grip harness, like those used for towing behind a boat, tend to be useful for persons learning basics or practicing advanced tricks. Depending on the line length the skier's location can be abreast or astern of the boat. An example of such kinds of booms is shown in Naypaver U.S. Pat. No. 4,480,577. Booms which are directly held by the skier are especially useful for neophyte water skiers and learners who are somewhat physically disabled. U.S. Pat. No. 3,390,658 of Jelks shows such kind of boom mounted off a sled towed behind the boat. When the boom is mounted athwart the boat gunnel, the skier will be adjacent the boat.

The present invention pertains to the latter kind of booms; those which are directly grasped by the skier. The gripping location should desirably have a relatively non-slip surface, especially in view of the lubricating effect of the splashed water and the likely unpracticed grip of the skier. Yet, good solutions have not been found or offered to the users.

Typically, the booms are made of a corrosion resisting metal, such as anodized almumimum. But bar stock has a characteristic smooth mill finish and as such bars are difficult to hold onto. If the bar is lightly knurled, the grip is not sufficiently improved. If the surface is heavily knurled, the result may be and distress to the skier's hands.

Polymer coatings, such as coatings of epoxy or polyester resins, are often put on metal marine objects for purposes of appearance and protection. However, such coatings typically replicate the finish of the underlying substrate, and if anything, they will tend to make it smoother. Thus, they per se are not particularly helpful in providing better grip. Where the boom crosses the boat gunnel it may from time to time impact it. Thus a sleeve of plastic is commonly slipped on the shaft for softening any blow but it is susceptible to slippage and increases the shaft diameter. Of course, anything that aids a person's grip on a boom ought not increase the diameter beyond that natural for typical children and adults nor reduce the diameter and structural strength.

Other requirements are that the boom be durable and of low weight.

Thus, there is a need for improvements in booms, to obtain better gripping, while meeting the various other performance requirements and, of course, doing so in an economic manner.

SUMMARY OF THE INVENTION

An object of the invention is to provide shafts, such as water ski booms, with polymer sleeves. An more particular object is to provide for improved gripping where a skier holds a boom, along with desirable smooth and corrosion resisting properties in other areas which are not gripped. Another object of the invention is to provide booms with different property polymer surfaces in different areas in an inexpensive manner.

According to the invention, a shaft useful as a boom is comprised of a primary diameter shaft having a subsection which is tapered along its length; around the subsection is a polymer sleeve having a thickness which tapers inversely along the shaft length to the direction of the taper of the subsection; preferably the outside diameter of the polymer sleeve is constant.

In a preferred embodiment, the subsection is at the outer end of the boom and a vinyl polymer, polyvinyl choride (PVC), has a compressibility, resilience, and frictionality that provides good griping. The PVC is applied to the shaft by dipping the shaft vertically into a plastisol liquid, to obtain a coating which is then cured.

In another embodiment, the shaft has two spaced apart PVC coated subsections and the aluminum of the shaft in other areas is coated with another polymer, such as polyester resin applied by the powder coat method. The outer subsection is as described, for gripping. The inner subsection is located to protect the gunnel and the PVC sleeve here is harder than at the outer section. The polyester is still harder than the PVC sleeve at the gunnel subsection. To obtain a combination of polyester coating and one or more PVC sleeves, a curing cycle is used wherein the PVC is applied and partial cured first, followed by applying the polyester as a powder coat, followed by full curing of both materials.

In the invention overcomes the limitations of the prior art in cost or feasibility, to achieve the same result. The invention provides a grip which adhered and contained in the depressed area along a simply machined shaft. The vinyl application process ensures that there will be good adhesion betwen the sleeve and underlying shaft. The combination of properties along the shaft optimally aid its utility.

The foregoing and other objects, features and advantages of the invention will become more apparent from the following description of the best mode of the invention and accompanying drawings.

DESCRIPTION OF THE BEST MODE

Figure 1:
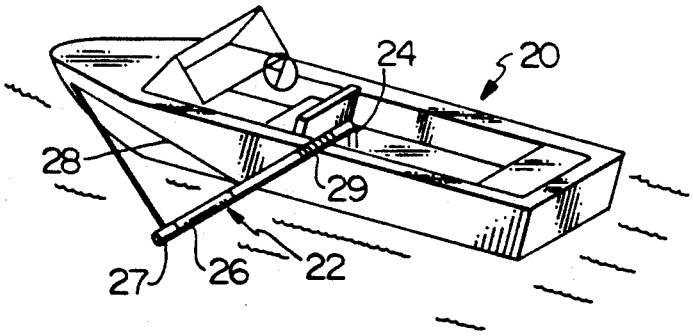
FIG. 1 shows a ski boom extending from the side of a motor boat and supported by lines running to the bow.

FIG. 1 shows a motor boat 20 having a water ski boom 22 extending across its side or gunnel. The boom has a grip subsection 26 near the outer end where a skier manually grasps it during use. The boom is mounted at one end on pylon 25. Horizontal plane rearward motion is resisted by flexible cables 28 which connect the boom outer end 27 of the boom to fastners at the bow of the boat. Thus, when there is rolling motion of the boat, the boom is able to rotate in the vertical plane, remaining at the grip height convenient to the skier. However, when the rolling is great or the skier falls, note that the boom will drop on the gunnel and potentially slide fore and aft.

Figure 2:
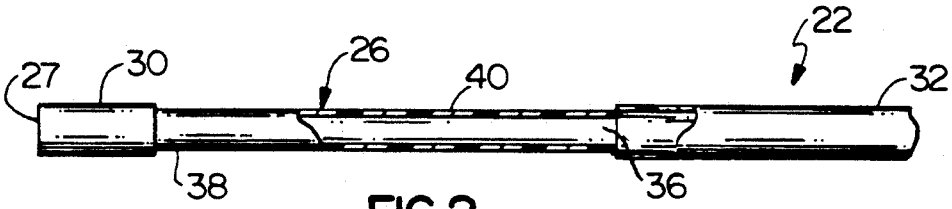
FIG. 2 shows in partial length and cross section a boom shaft having a reduced outside diameter vinyl grip sleeve and a polyester coating on the other part of the shaft.

FIG. 2 shows in detail a preferred embodiment of the boom. It is a round metal shaft made of 6061 T6 aluminum alloy having an indentation hardness of about Brinell No. 95. The shaft has reduced outside diameter grip subsection 26 near its outer or free end 27. Nominal primary diameter shaft parts 30, 32 are on either side of the grip subsection. The grip subsection has a circumscribing layer or sleeve 40 of vinyl polymer, in particular polyvinyl chloride (PVC), chosen for its durability and ultraviolet light resistance, but most importantly for its frictional surface character, compressibility and resilience, compared to the aluminum and other polymers, to enable easy hand gripping.

The subsection of the shaft length having the vinyl layer is tapered from a major diameter at its innermost subsection first end 36 to a smaller minor diameter at its subsection second end 38 nearest the outer end 30, 27 of the shaft. The vinyl layer of the sleeve is tapered in the opposite axial direction of the shaft subsection taper, so that the outside diameter of the sleeve surface is nominally a constant diameter.

Figure 3:
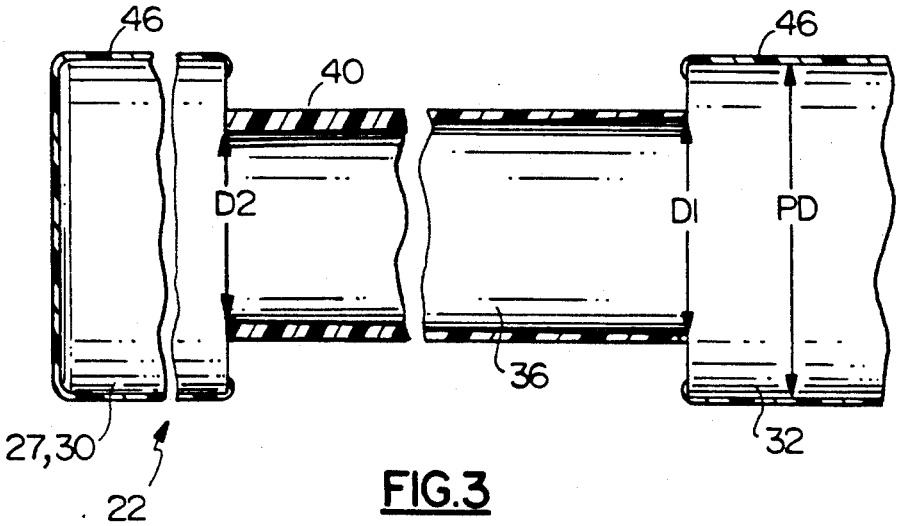
FIG. 3 shows in closer detail a cross section a portion of boom shaft of FIG. 2, with an added polymer coating.

FIG. 3 shows in even more detail portions of the shaft of FIG. 2, with an added polymer coating 46. The shaft 30, 32 has a primary diameter PD and the subsection 36 has a taper with a first major diameter D1 at the one end and a smaller minor diameter D2 at the other end of the subsection, near the outer or free end 48 of the shaft. Thus PD>D1>D2. The metal shaft has a thin 0.003-0.007 inch thick polyester coating 46 in parts adjacent the vinyl and along its length. The coating protects the shaft metal from corrosion and abrasion. It is more resilient than the metal and thus resists permanent impact damage. It is harder and generates less frictional force, compared to the PVC of the grip sleeve.

The nominal dimensions of the shaft shown in FIGS. 2 and 3 are as follows. The shaft has a primary diameter of 1.5 inch and a length of 72 inch. The subsection is about 24 inch length and starts about 8 inch from the outer end. The vinyl of the grip subsection has an outside diameter of 1.36 inch; the metal in the subsection tapers from a diameter of 1.26 inch to 1.20 inch at the outer end thereof. Thus, the vinyl layer thickness varies betwen about 0.05 and 0.08 inch along the subsection. (It shall be appreciated both that the drawings are not to scale, to better illustrate the concept of the invention, and that the foregoing dimensions are only illustrative.) Of course, the outside diameter of the sleeve is chosen for convenience of gripping and must be relatively small; in alternate embodiments, where structural considerations permit, the outside diameter of the shaft adjacent the grip may be equal or less than the sleeve outside diameter.

The PVC resin is applied to the shaft by heating the shaft and dipping it in a polymer liquid, preferably a plastisol—or mixture of fine particle dispersion resins with plasticizers. Preferred presently for the use of the invention as a ski boom is P-400 plastisol (Indasol Co., Sutton, Mass., USA), based on a vinyl copolymer. The hardness of the cured PVC can be varied through proprietary formulation by the material manufacturer or by addition of an oil based plasticizer, DOP, at the point of processing. To enhance bonding, the shaft is coated with a primer, such as No. P-1157 (Plasto-meric Inc., Sussex, Wis.). Other analogous polymer accretion techniques can be employed, e.g., PVC processing with organosols and solvent solutions. In the preferred practice of the invention, the grip portion has a Shore A indentation hardness of 60 or less, more preferably less than 40,most preferably between 20-40.

Figure 4:
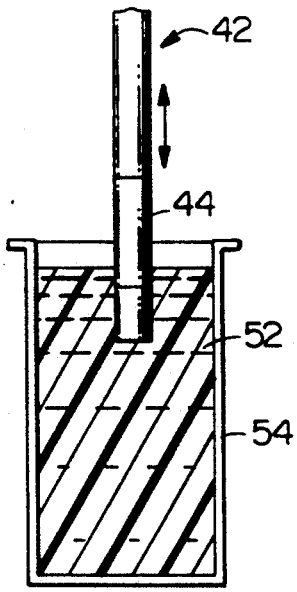
FIG. 4 shows how the shaft is dipped in vinyl to form the sleeve.

FIG. 4 illustrates how the PVC sleeve is fabricated on the shaft. The shaft 42 is cleaned, lightly sandblasted, coated with primer at subsection 44. The shaft is heated in a oven at 450 F. for about 10 min, and then lowered vertically into the room temperature polyvinyl containing liquid in vessel 54. The rate of immersion and withdrawal is such that the shaft subsection is only in the bath for about 10 seconds. The smaller diameter of the taper of the grip subsection 44, being at the lower end of the subsection, enters the bath first and leaves it last. Upon withdrawal, the vinyl is adhered to the shaft in partially cured state with a thickness that is greater at the lower minor diameter end of the subsection, compared to the upper end. PVC adhered in unwanted areas is removed and the PVC of the subsection is post-cured by heating it, e.g., at 350 F. for 6-10 min, or exposing it to ultraviolet light, for suffficient time. Greater or lesser thickness of PVC can be applied by generally changing temperature of shaft and the time of immersion. To facilitate the mechanics of the foregoing process, the shaft is designed so the tapered subsection minor diameter is located nearest to an end of the shaft, so the least amount of shaft has to be immersed to make the sleeve.

When desired, a commercial polyester coating is applied to the shaft after the PVC sleeve is made. The coating is normally applied by spraying electrically charged powder toward an oppositely charged metal part, followed by oven heating at 350 F. for 3-5 min, to fuse the powder and form the coating. Preferably, the powder coat is from Morton/Corvel20000 Series Polyester Powder (Morton Thiokol, Inc., Reading, Pa.). The resultant 0.003-0.007 inch coating has specific gravity of 1.2-1.8; a pencil hardness between H and 3H, preferably 2H, as hardness is tested by American Society of Testing Materials (ASTM) procedure D3363; and impact number of 40-160 inch lb, as measured by ASTM D2794. Other thin coatings than the prefered polyester may be used on the shaft parts that do not have PVC coatings. They include other polyesters and expoxies. Examples are, those based on TGIC polyester powder (Corvell 30000 Series Powder), epoxy (Corvell 10000 Series Powder), and the proprietary Corvell 40000 Series Hybrid Powder.

When producing the preferred shaft having both a polyester coating and a PVC sleeve grip area, a special multi-step and combined curing cycle process is employed to avoid incompatibilities in the curing cycles which could result in degradation of the PVC or incomplete cure of the polyester. The shaft is processed as described first above in connection with FIG. 4, to the point of removal from the bath when it is only slightly cured. Then, the PVC coating is additionally partially cured only to the extent of enabling manual touch and handling, by heating to 450–500 F. for about 5 min. The shaft masking and any surplus material are removed. Then, the PVC sleeve is masked and the aforementioned preferred polyester powder is applied and partially cured by oven heating at 350 F. for 3–5 min. The shaft is cooled and the masking on the sleeve is removed. The shaft is placed in a 350–400 F. oven for 20–30 min, to cure both the polyester and PVC and attain their desired properties. Of course, the foregoing parameters will vary with greater or lesser mass of shaft.

Figure 5:
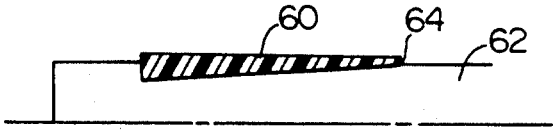
FIGS. 5-7 show different configurations of vinyl sleeve.
Figure 6:
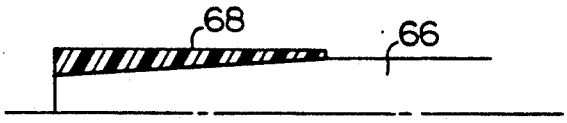
Figure 7:
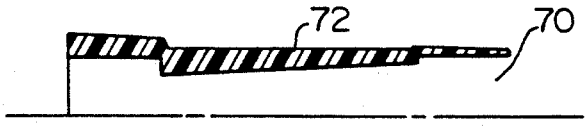

The foregoing preferred shaft will have a first section surfaced with a first polymer that has greater resilient and less hardness than the underlying metal, and a second section surfaced with second polymer which is harder than the polymer of first subsection, but more resilient than is the metal. Generally, other polymers and elastomers having suitable properties may be substituted for the preferred materials in the practice of the invention. FIG. 5–7 illustrate different configurations of the invention to show variations within the scope thereof. FIG. 5 shows a shaft 62 having vinyl 60 applied to a taper where the major diameter at 64 is equal the shaft primary diameter. FIG. 6 shows a shaft 66 having a taper subsection and circumscribing vinyl 68 which is at the very end of the shaft. FIG. 7 shows a shaft 70 like that of FIG. 3, but where masking of the PVC has not been used; nonetheless the outside diameter of the vinyl 72 in the grip subsection is nominally constant, to provide good gripping surface where it is needed.

Figure 8:
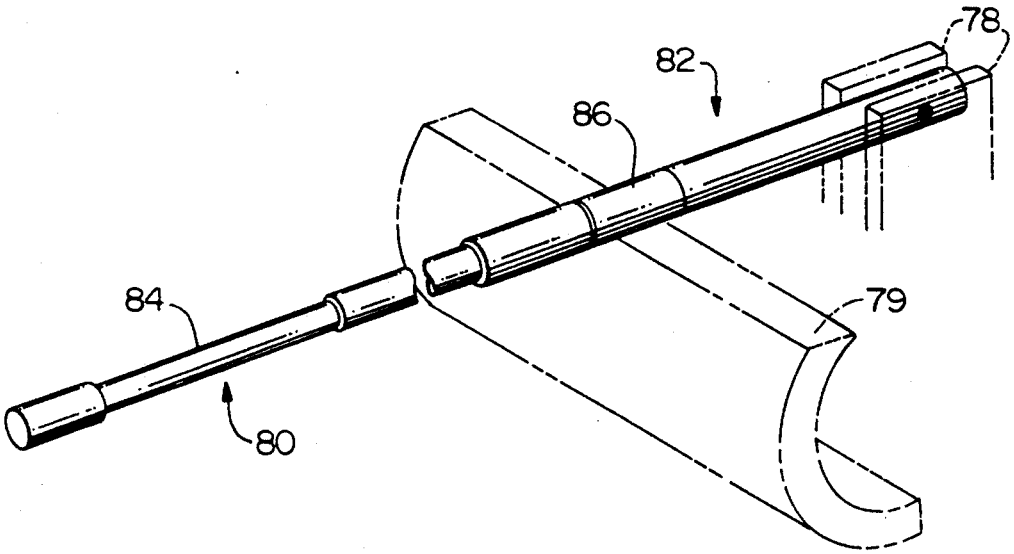
FIG. 8 shows a two piece shaft having an outboard part having a grip sleeve that slides into and is held by an inboard part with a gunnel sleeve.

FIG. 8 shows another embodiment of the invention. The boom is pinned to a plate like structure 78 of the boat and extends across the boat gunnel 79, both shown in phantom. The boom assembly is comprised of an outer portion 80 having a grip subsection 82 as described in connection with FIG. 2 and 3, and a tubular inner portion 82 having a nominal 2 inch outside diameter. The boom has an additional sleeve 86 that mitigates the effects of boom contact with the gunnel on which it mostly rides during use, moving somewhat to and fro. The sleeve may simply be a piece of vinyl tubing slid around the shaft, or employing the practice of the invention, the boom has a gunnel sleeve 86 of vinyl, nominally having 2 inch or greater outside diameter and 10 inch length, and up to one quarter inch thickness—as the polymer system may enable. The gunnel subsection of the shaft and its somewhat thicker vinyl layer are fashioned in the same manner and process as previous described for the grip subsection and sleeve. The gunnel sleeve however will have a different character than the grip sleeve since its function is to dampen any impact on the gunnel by having some compressibility and resilience, but at the same time to avoid frictional engagement. Thus, the gunnel sleeve preferably has a hardness intermediate those of the grip sleeve and the polyester coating, preferably 60 Shore A hardness or more.

When there are multiple materials on the shaft the choice among options will consider compatability of the curing cycles, whether carried out serially on in the combined curing step process. The process for providing a first and then a second polymer in two different subsections, with or without the thin polyester coating, may be carried out employing the same principles and procedures as described above.

Of course, in the practice of the essential invention only either one or the other of the grip or gunnel subsections may have the polymer sleeve. And the shaft may be made of a non-metallic material, such as graphite epoxy or other engineered material, in which case the polymer coating may be considered surplus.

The use of a cured-in-place vinyl on the tapered subsections provides advantage and distinction over other ways of putting a polymer or rubber sleeve on the shaft. Having the vinyl cured in place provides inherent adhesion to the metal, eliminating the cost and need of adhesives which might fail over time. Curing-in-place overcomes the difficult if not impossible task (depending on the dimensions) of sliding a preformed sleeve over the primary diameter outer end and having it then contract tightly around a smaller diameter subsection, while at the same time attaining in the sleeve the hardness and durability of the PVC materials mentioned above.

The invention will be applicable to solid and hollow shafts and to one piece and multi-piece devices for ski booms and other products. While the invention is described for a round shaft having a diameter, within the construction and scope of the invention will be encompassed shafts of non-circular cross sections where the diameter shall refer to the nominal width dimension. And although the invention is described in terms of a boom for a boat traveling on water, the terms "boat" and "water" should be understood to encompass other vehicles and machines adapted to hold the boom in a position wherein relative motion is obtained between the boom and water or other ski-able substance, be it liquid, granular or solid.

Although only the preferred embodiment has been described with some alternatives, it will be understood that further changes in form and detail may be made without departing from the spirit and scope of the claimed invention.

I claim:

1. A shaft with a polymer sleeve, adapted for mounting on a boat and towing a water skier, having a primary diameter and a length, comprising a shaft subsection tapering along the shaft length from a major diameter to a smaller minor diameter; a sleeve of a first polymer circumscribing the subsection, the sleeve thickness varying inversely with the diameter of the subsection; and, the first polymer having a resilience greater than the resilience of the shaft.

2. The shaft of claim 1 characterized by the subsection minor diameter located more proximate to an end of the shaft than is the subsection major diameter.

3. The shaft of claim 1 characterized by a subsection contained between two shaft sections, each having the primary diameter.

4. The shaft of claim 3 characterized by a sleeve having an outside diameter equal or less than the shaft primary diameter.

5. The shaft of claim 1 characterized by a second subsection tapered along the shaft length from a second major diameter to a second minor diameter; a second sleeve of a second polymer circumscribing the second subsection, the sleeve thickness varying inversely with the diameter of the second subsection; and, the second polymer having a resilience greater than the resilience of the shaft and a hardness greater than the hardness of the first polymer.

6. The shaft of claim 1 having a thin coating of second polymer on a shaft surface adjacent the sleeve, the second polymer having a hardness greater than the first polymer hardness and a resilience less than the shaft resilience.

7. The shaft of claim 5 having a thin coating of third polymer on a shaft surface adjacent the first or second sleeve, the third polymer having a hardness greater than the first and second polymer hardnesses.

8. The process of making a shaft with a polymer sleeve, for mounting on a boat and towing a water skier which comprises forming a shaft having a tapering diameter subsection; lowering the shaft vertically downward into a bath of first polymer containing liquid, so the smaller diameter of the subsection taper enters the bath first, to surround the subsection with liquid;

adhering first polymer from the liquid bath to the surface of the subsection;

withdrawing the shaft vertically from the bath with the adhered first polymer as a tapered thickness sleeve around the subsection, in the direction of the taper of the sleeve opposing in direction the taper of the subsection of the shaft; and, curing the first polymer, to form a sleeve of nominally constant diameter around the subsection.

9. A shaft made by the process of claim 8.

10. A boat having a ski boom for towing a water skier through the water comprising a shaft mounted transversely to the length of the boat and extending outboard from the boat gunnel to a location where a skier in water next to the boat may grip the shaft;

a subsection near the outboard end of the shaft, having a taper along the shaft length, from a major diameter to a smaller minor diameter proximate the outboard end of the shaft;

a sleeve of a first polymer circumscribing the subsection, the sleeve thickness varying inversely with the diameter of the subsection; and the first polymer having a resilience greater than the resilience of the shaft.

11. The boat of claim 10 characterized by the shaft having a second sleeve of a second polymer circumscribing the shaft where it crosses the gunnel.

12. The boat of claim 11 characterized by the second sleeve circumscribing a second subsection tapered along the shaft length from a second major diameter to a second minor diameter; the sleeve thickness varying inversely with the diameter of the second subsection; and, the second polymer having a resilience greater than the resilience of the shaft and a hardness greater than the hardness of the first polymer.

* * * * *